US005517393A

United States Patent [19]

Townsend, Jr. et al.

[11] Patent Number: 5,517,393

[45] Date of Patent: May 14, 1996

[54] ILLUMINATION ASSEMBLY

[76] Inventors: George H. Townsend, Jr., 230 Orwig Rd., New Freedom, Pa. 17349; Robert J. Townsend, Sr., 3505 Gwynnbrook Ave., Owings Mills, Md. 21117

[21] Appl. No.: 343,987

[22] Filed: Nov. 18, 1994

[51] Int. Cl.[6] ..... F21V 1/00

[52] U.S. Cl. ..... 362/233; 362/238; 362/386; 40/560; 40/624

[58] Field of Search ..... 362/233, 238, 362/386; 40/559, 560, 624

[56] References Cited

U.S. PATENT DOCUMENTS

| | | | |
|---|---|---|---|
| 2,612,861 | 10/1952 | Burkey | 362/233 |
| 4,441,145 | 4/1984 | Antkowiak | 362/386 |
| 4,492,049 | 1/1985 | Gaylor | 40/624 |
| 4,954,935 | 9/1990 | Hammond et al. | 40/560 |

FOREIGN PATENT DOCUMENTS

| | | | |
|---|---|---|---|
| 1112201 | 8/1961 | Germany | 362/233 |

*Primary Examiner*—Carroll B. Dority
*Attorney, Agent, or Firm*—Vorys, Sater, Seymour & Pease

[57] ABSTRACT

An illumination assembly allowing quick and easy access to traffic, billboard or other lighting is provided. The illumination assembly includes a rotatable conveyor assembly having a cable or cord driven by one or more drive pulleys to rotatably place lighting luminaires over supported operating, maintenance or other areas. When a light bulb contained in a luminaire burns out or otherwise requires servicing, the rotatable conveyor assembly is activated to drive the corresponding luminaire to a maintenance area, having a maintenance support plate. The luminaire is conveniently and safely serviced, and the conveyor cord then drives the luminaires back to their normal lighting positions. Reconfiguration in the field with greater or lesser luminaires, track size or otherwise is possible.

11 Claims, 3 Drawing Sheets

ILLUMINATION ASSEMBLY

FIELD OF THE INVENTION

The invention relates to an apparatus for mounting and conveniently repairing the lights of an illuminated traffic display, signboard or other display surface.

BACKGROUND OF THE INVENTION

Traffic displays and other display surfaces have long been provided with electric lighting for nighttime, special effects and other illumination. Examples include overhead traffic displays with directional signs, highway speed, exit or other markings, or billboard or other advertisements. While such lighting has been well known, still the use and installation of such fixtures, including the mounting structure or "luminaires" for the light bulbs themselves, has not always been easy, safe or convenient.

For instance, a typical traffic display might be provided with a plurality of luminaires running along the bottom ledge of the display support structure, to provide evenly distributed lighting across the display surface. However, when a bulb burns out and requires replacement, which may be on the order of every 18 months for a conventional bulb, typically 250 or 400 watts, it may not be easy for a workman to ascend the traffic display structure and gain access to the deficient bulb.

This is especially true for traffic displays which are installed close to, or as is often the case, completely overhanging, the highway. In such installations, the workman may actually have to climb a ladder, "cherry picker" or other support set up at the edge of, or over into, the highway itself to reach the deficient bulb. Repair work under those circumstances of course runs the danger of workmen being put in or over the path of traffic, or the possibility of tools, bulbs or other material being dropped into traffic's way.

In addition, repair in this fashion is expensive, involving costs which can begin at a few thousand dollars including workman time, vehicles, material, costs associated with lane closings, and other costs.

SUMMARY OF THE INVENTION

It is accordingly an object of the invention to provide an illumination assembly which is easy, convenient and safe to install, maintain and repair.

It is another object of the invention to provide an illumination assembly which may be mounted on traffic displays, billboards or other structures placed in a relatively close proximity to a highway or other hard-to-access areas.

It is another object of the invention to provide an illumination assembly which can receive and mount a plurality of luminaires, yet allow easy access to and replacement of each luminaire and associated bulb.

It is another object of the invention to provide an illumination assembly which can be fitted with any desired number of luminaires, to illuminate display surfaces of different sizes and configurations.

It is another object of the invention to provide an illumination assembly which provides a slidable conveyor assembly capable of routing installed luminaires and bulbs around a billboard mounting track.

It is another object of the invention to provide an illumination assembly which is reliable and durable, including against wind and weather.

It is another object of the invention to provide an illumination assembly which can be serviced with reduced hazard to workmen, and to nearby traffic.

It is another object of the invention to provide an illumination assembly which can be serviced with reduced cost.

The invention achieving these and other objects is in one aspect an illumination assembly including a billboard mounting structure fixed to the base of a billboard or other display surface, a rotatable conveyor assembly capable of receiving a plurality of luminaire assemblies and associated light bulbs, and a drive assembly for selectively rotating the rotatable conveyor assembly to position a subject luminaire in a maintenance position.

BRIEF DESCRIPTION OF THE DRAWINGS

The invention will be described with reference to the accompanying drawings, in which like parts are labelled with like numbers. The drawings are briefly described below.

DETAILED DESCRIPTION OF THE DRAWINGS

Figure 1:
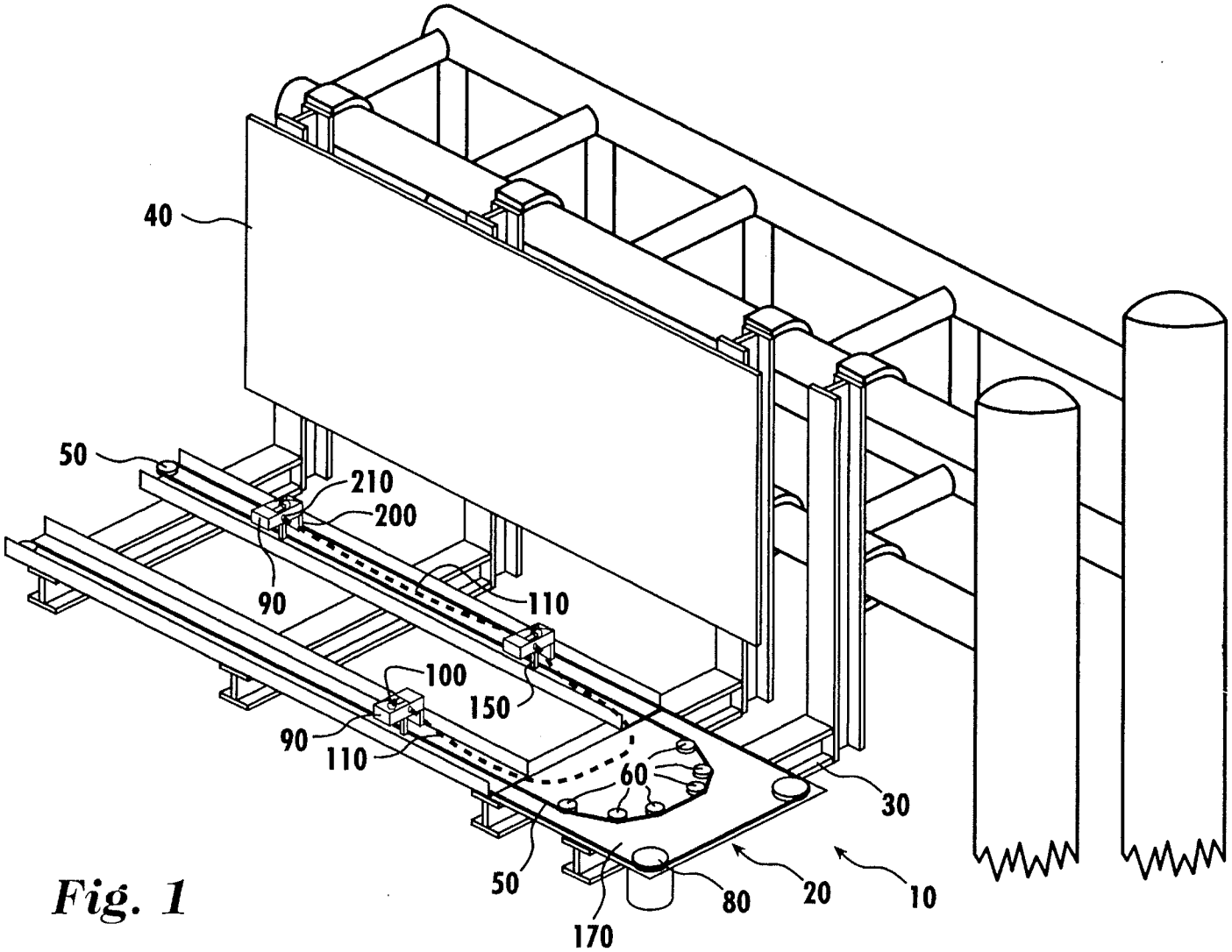
FIG. 1 illustrates an illumination assembly according to the invention.
Figure 2:
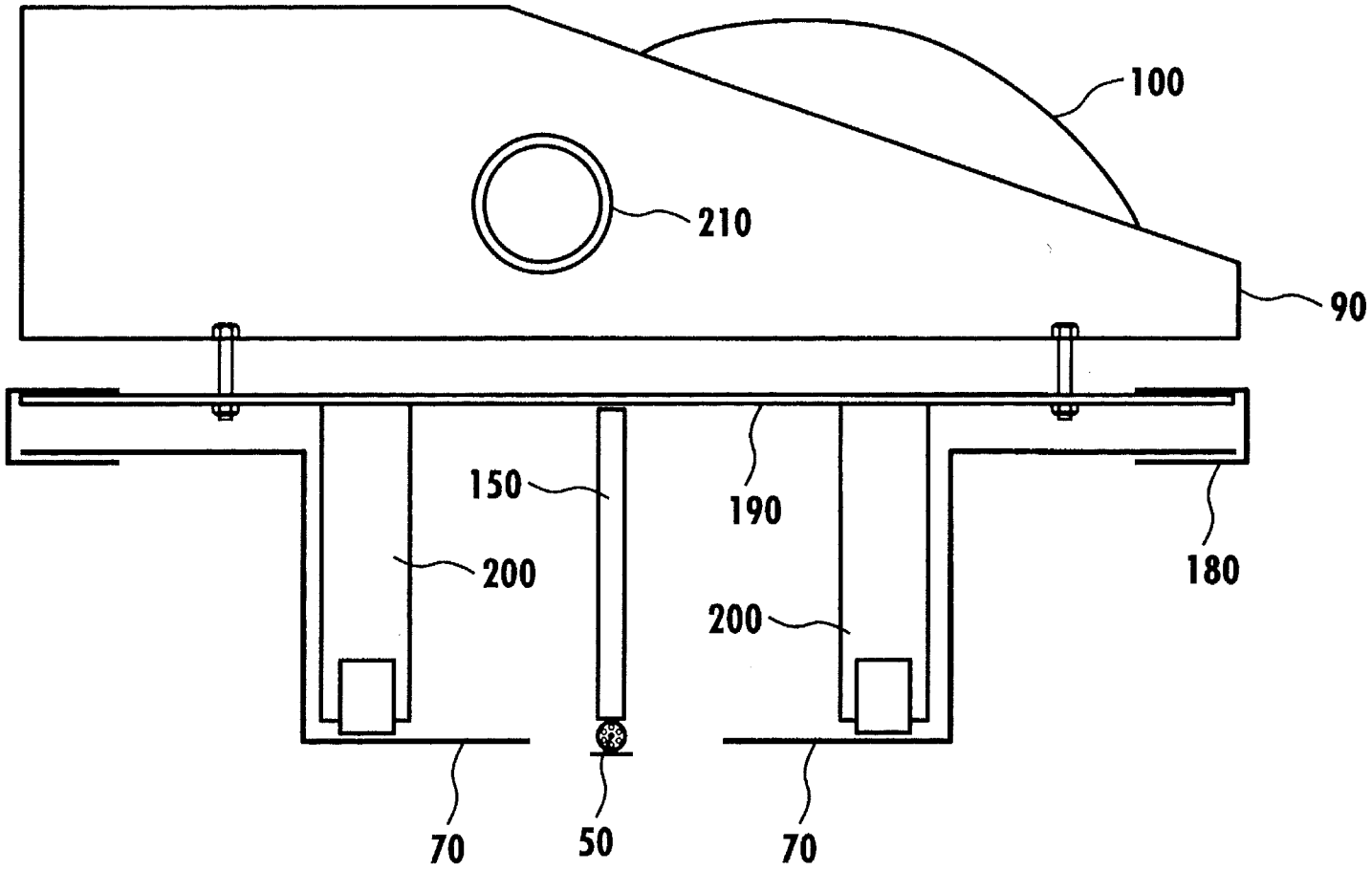
FIG. 2 illustrates a side view of a luminaire deployed in the illumination assembly of the invention.
Figure 3:
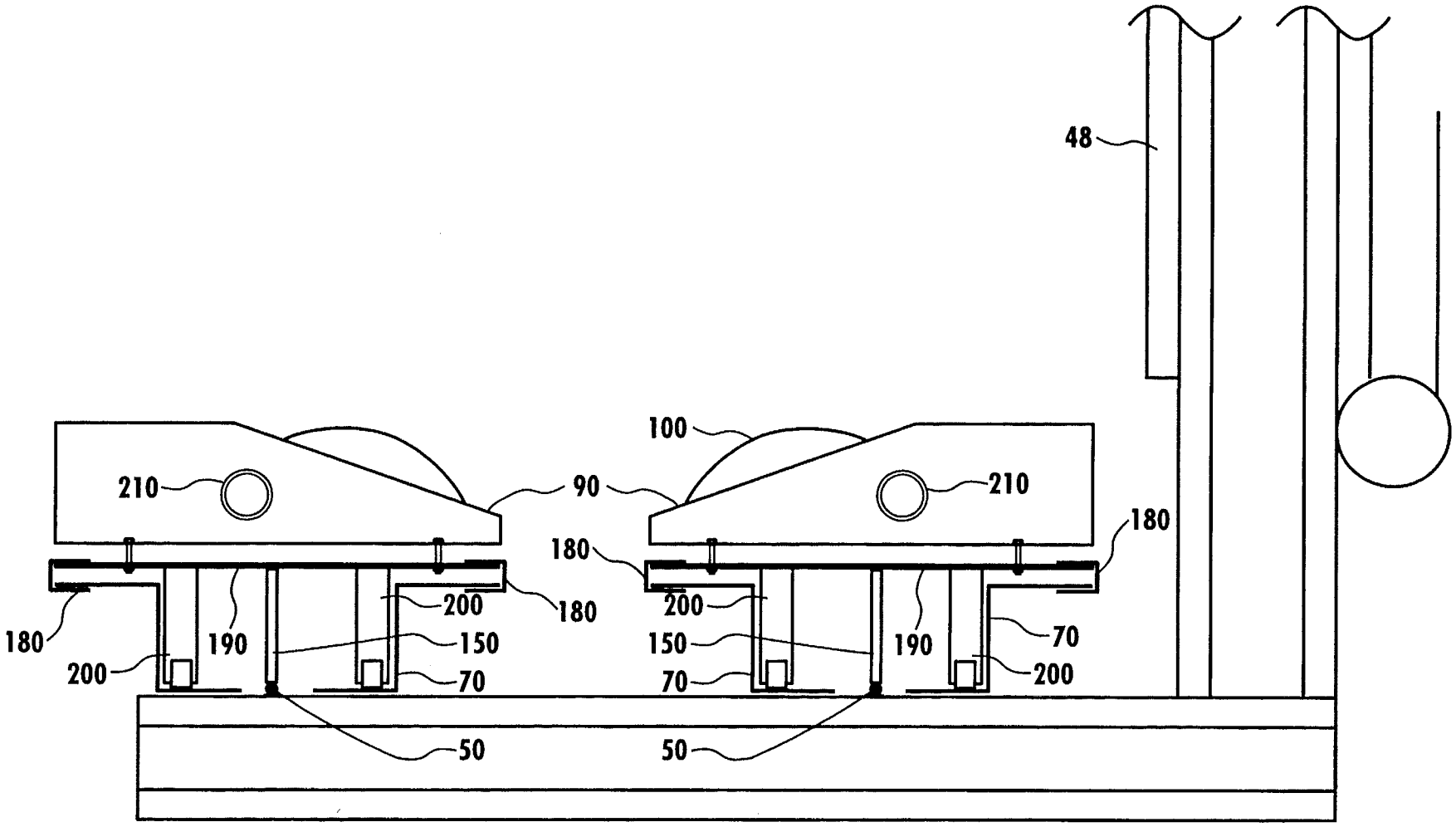
FIG. 3 illustrates an illumination assembly of the invention from a side view.

A preferred embodiment of the invention is illustrated in FIGS. 1–3. The embodiment provides an illumination assembly 10 generally provided with a rotatable conveyor assembly 20, mounted along the base 30 of an illuminated display surface 40, which may for instance be a billboard or other advertising placard.

In the illustrated embodiment, the rotatable conveyor assembly 20 includes a conveyor cable or cord 50, constructed as a closed-loop circuit. Other conveyor configurations can be used. Conveyor cord 50 in the illustrated embodiment is deployed in a generally U-shaped configuration, and is engaged around a plurality of idler pulleys 60 which permit the travel of conveyor cord 50 around the perimeter of a maintenance track 70 through bearing action. Conveyor cord 50 may be made of high-tension corded steel, or other suitable material.

The rotatable conveyor assembly 20 also includes at least one drive pulley 80 which can be selectively driven, for instance by electricity, to rotate and drive conveyor cord 50 around maintenance track 70. It will be appreciated that drive pulley 80 can be alternatively powered by means of a hand crank, in winch fashion, including in instances when reduced system cost is desired, or by other suitable drive means.

Drive pulley 80 may be powered for selected periods of time so as to allow conveyor cord 50 to rotate a desired distance around maintenance track 70, for instance by release and engagement of an electric power switch, or other means. Both the idler pulleys 60, drive pulley 80 and other devices in maintenance track 70 may be provided with a cable guard or collar, to prevent conveyor cord 50 from slipping off during times when some tension may be lost and conveyor cord 50 goes slack.

Attached to conveyor cord 50 are a plurality of luminaires 90, each of which receives at least one light bulb 100 for illumination of display surface 40. As illustrated in FIG. 2, luminaires 90 may be attached to the conveyor cord 50 by a bracket pivotally attached to the laminare at one end and to the conveyor cord by a cable clamp or bracket 150, or other appropriate means at an opposite end.

The luminaires 90 may be guided around selected portions of maintenance track 70 by means of a C-shaped channel 180 which receives a guide plate 190 of luminaire 90, supporting and guiding the travel of the luminaire, including to prevent the luminaire from lifting in wind.

In the illustrated embodiment, C-shaped channel 180 is provided in both an operating section in which luminaires 90 face the display surface 40, and a docking section generally parallel to the operating section in which idle luminaires 90 face away from display surface 40, during servicing of other luminaires.

This configuration permits convenient storage, on a temporary basis or longer, of luminaires 90 which are rotated out of operating position during repair of other luminaires. Other configurations of C-shaped channel 180 for support, temporary docking and storage or other purposes are possible. Luminaires 90 may also be supported by rollers 200.

Each of luminaires 90 includes electrical socket, cabling conduits 210 and other structure necessary to receive and mount light bulb 100, as will be understood by persons skilled in the art. An example of luminaires suitable for use in the invention are those manufactured by, and commonly available from, General Electric Corporation. Light bulb 100 may be of any appropriate type and intensity for casting light on display surface 40.

Luminaires 90 are illustrated as mounted in a predetermined spaced relationship along conveyor cord 50. The separation between each of luminaires 90 is dictated by the desired lighting application, and for a roadside traffic display may be for instance on the order of a few feet, but is generally not greater than six feet. It will be appreciated that any desired number of luminaires can be attached to conveyor cord 50, in any desired spacing, regular or irregular, according to desired lighting and other effects.

This permits great flexibility when installing, modifying or upgrading traffic, advertising or other systems illuminated by illumination assembly 10 of the invention, because lighting density can be increased or thinned out, additional display surfaces can be added, or other modifications can be made using the same basic illumination platform, by merely attaching or re-attaching luminaires or adjusting the length of maintenance track 70 and conveyor cord 50. Illumination assembly 10 of the invention is, in other words, scalable and configurable, in a convenient manner in the field.

Each of luminaires are affixed to conveyor cord 50 with appropriate electric power cabling 110 to enable the light bulb 100 of each luminaire to be lit. Parallel connection is preferred, so that one defective bulb does not interrupt the lighting system as a whole.

Electric power cabling 110 flexibly advances with conveyor cord 50, when drive pulley 80 is driven by motor, hand crank or other means. Electric power cabling 110 can be housed in flexible conduits, if desired.

During normal operation, conveyor cord 50 is advanced to such a position as to allow each of luminaires 90 to rest at an appropriate illumination position, that is, facing and directing light toward display surface 40.

Of course, the bracket mounting of luminaires 90 in conveyor cord 50 allows desired spacing between each luminaire 90 to be set, and guiding conveyor cord 50 to a proper position with luminaires 90 facing the display surface 40 is a relatively straightforward task, which may be assisted by providing an engagement stop of appropriate type in maintenance track 70. Additional pinion or other tensioner devices may be provided to put a desired level of tension on drive pulley 80.

When the light bulb 100 of a given luminaire 90 burns out or otherwise requires maintenance, the rotatable conveyor assembly 20 may be used to quickly, safely and easily access the light bulb and return to normal operation.

When a light bulb requires such maintenance, a workman activates the at least one drive pulley 80 so as to cause the conveyor cord 50 to rotate toward a maintenance section 140 of the maintenance track 70.

Maintenance section 140 includes a maintenance support plate 170, made of aluminum, stainless steel or other suitable material, to generally undergird and provide a strong working area for maintenance section 140. Maintenance support plate 170 is positioned at a safe point, for instance to the side, relative to display surface 40. If the illumination assembly 10 of the invention is provided in a highway traffic display or billboard, maintenance support plate 170 may be positioned at the side farthest from the highway surface to ensure maximum safety and convenience to the workman.

This is in distinct contrast to previous repair techniques which require maintenance personnel to go out over a highway lane, at risk to accident and injury. Maintenance support plate 170 serves to provide a stable platform to support the luminaire having the defective light bulb while the luminaire is inspected, removed and replaced, or otherwise maintained.

Each of the luminaires 90 may be tested while in a maintenance position over maintenance support plate 170 by means of auxiliary power test cabling (not shown), which can be plugged into the usual sockets on the luminaire and powered during repair. This permits the workman to see if the repaired light bulb 100 is working, before activating drive pulley 80 to return the luminaire to its operating position. Luminaire 90 may also be provided with quick-disconnect type electrical connectors on either side of the luminaire, so that if it turns out that it is not the bulb but the luminaire itself which is defective, the connectors may be quickly detached and a new luminaire substituted at the same position.

When the defective one or more of the luminaires 90 or associated light bulbs 100 are properly serviced, the workman activates drive pulley 80 to drive the conveyor cord 50 and locate luminaires 90 back to a proper operating position facing display surface 40.

The illumination assembly 10 of the invention can then be used to apply normal lighting to display surface 40, with a minimum of climbing, traffic disruption, hazard and other inconvenience to access and service the subject luminaires and associated bulbs.

The foregoing description of the illumination assembly of the invention is illustrative, and variations on certain aspects of the inventive system will occur to persons skilled in the art. The scope of the invention is accordingly intended to be limited only by the following claims.

What is claimed is:

1. An illumination assembly including means supporting a plurality of light mounting fixtures for illuminating a display surface over a thoroughfare, comprising:

a support frame positioned adjacent to the display surface and extending at least partly over the thoroughfare; said plurality of light mounting fixtures resting on said support frame;

an endless movable conveyor assembly, connected to said support frame, guiding the plurality of light mounting fixtures on a track guide assembly extending over at least a portion of said support frame, at least of a portion of said track guide assembly being in a generally parallel relation to the display surface; means on said light mounting fixtures for engagement with said track guide assembly to guide said light mounting fixtures about said track guide assembly; and a reversible drive apparatus adapted to rotate in a single direction for selectively moving said conveyor assembly to move said light mounting fixtures about said track guide assembly to a maintenance position of said support frame out from over the thoroughfare for servicing, then return the light mounting fixtures to an operating position for illumination of the display surface.

2. An illumination assembly according to claim 1, wherein said drive apparatus comprises a drive pulley operatively connected to said conveyor assembly.

3. An illumination assembly according to claim 2, wherein said drive pulley further comprises a hand crank for manually driving the drive pulley and selectively positioning the light mounting fixture.

4. An illumination assembly according to claim 2, wherein said drive pulley further comprises a drive motor for driving the drive pulley and selectively positioning the light mounting fixtures at the maintenance position.

5. An illumination assembly according to claim 1, wherein each of the plurality of light mounting fixtures between a first and a last is evenly spaced from the next.

6. An illumination assembly according to claim 1, wherein lights mounted in the light mounting fixtures illuminate a traffic display.

7. An illumination assembly according to claim 1, wherein lights mounted in the light mounting fixtures illuminate an advertising display.

8. An illumination assembly according to claim 1, further comprising an electric cabling assembly for guidedly connecting electric cabling between the light mounting fixtures and an electric power supply.

9. An illumination assembly according to claim 1, wherein said track guide assembly comprises C-shaped guide sections attached to said support frame for guidedly supporting the light mounting fixtures between arms thereof around at least selected portions of the support frame.

10. An illumination assembly according to claim 9, wherein the display surface is a vertical surface, and said guide sections comprise at least one section positioning the light mounting fixtures to cast light upon the display surface.

11. An illumination assembly according to claim 9, wherein said guide sections comprise at least one docking section for positioning the light mounting fixtures in an inactived position.

* * * * *